US006115563A

United States Patent [19]

Miyamoto

[11] Patent Number: 6,115,563

[45] **Date of Patent: *Sep. 5, 2000**

[54] IMAGE FIXING APPARATUS

[75] Inventor: Toshio Miyamoto, Numazu, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/184,847

[22] Filed: Nov. 3, 1998

[30] Foreign Application Priority Data

Nov. 7, 1997 [JP] Japan ..... 9-322095

[51] Int. Cl.[7] ..... G03G 15/20; H05B 1/00

[52] U.S. Cl. ..... 399/67; 219/216; 399/328

[58] Field of Search ..... 219/216; 399/43, 399/67, 69, 320, 324, 328, 329, 330, 331, 335, 370

[56] References Cited

U.S. PATENT DOCUMENTS

| | | | |
|---|---|---|---|
| 5,253,024 | 10/1993 | Okuda et al. | 355/282 |
| 5,293,202 | 3/1994 | Adachi et al. | 355/282 |
| 5,512,993 | 4/1996 | Endo et al. | 399/335 |
| 5,552,874 | 9/1996 | Ohtsuka et al. | 399/335 |
| 5,722,026 | 2/1998 | Goto et al. | 399/333 |
| 5,724,637 | 3/1998 | Senba et al. | 399/333 |
| 5,860,051 | 1/1999 | Goto et al. | 399/529 |

FOREIGN PATENT DOCUMENTS

| | | |
|---|---|---|
| 0 597 496 | 5/1994 | European Pat. Off. . |
| 0 609 100 | 8/1994 | European Pat. Off. . |
| 63-313182 | 12/1988 | Japan . |
| 2-157878 | 6/1990 | Japan . |
| 4-044075 | 2/1992 | Japan . |
| 4-044076 | 2/1992 | Japan . |
| 4-044077 | 2/1992 | Japan . |
| 4-044078 | 2/1992 | Japan . |
| 4-044079 | 2/1992 | Japan . |
| 4-044080 | 2/1992 | Japan . |
| 4-044081 | 2/1992 | Japan . |
| 4-044083 | 2/1992 | Japan . |
| 4-04482 | 2/1992 | Japan . |
| 4-204980 | 7/1992 | Japan . |
| 4-204981 | 7/1992 | Japan . |
| 4-204982 | 7/1992 | Japan . |
| 4-204983 | 7/1992 | Japan . |
| 4-204984 | 7/1992 | Japan . |
| 06-027855 | 2/1994 | Japan . |
| 07-191571 | 7/1995 | Japan . |

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

The present invention provides an image fixing apparatus which comprises a heater for generating heat upon receiving electric power supply thereto, a film movable with an unfixed image on a recording material while being in contact with said heater, a backup roller for forming a nip with said heater, with said film being interposed in the nip, and fixing condition setting means for setting an image fixing condition according to a size of the recording material conveyed to the nip in a preceding image fixing operation and a size of the recording material conveyed to the nip in the current image fixing operation.

17 Claims, 6 Drawing Sheets

IMAGE FIXING APPARATUS

BACKGROUND OF THE INVENTION

1. Field of the Invention

The present invention relates to an image fixing apparatus (device) adapted for use in an image forming apparatus such as a copying apparatus or a printer, and more particularly to an image fixing device of a low heat capacity.

2. Related Background Art

Conventionally, the electrophotographic image forming apparatus such as copying apparatus or printer is provided with a fixing device for fixing an unfixed image (toner image) formed on a recording material.

A part of such fixing devices employs, as the fixing means, the film heating type of energy saving type.

The fixing device of the film heating type is disclosed for example in the Japanese Patent Laid-open Application Nos. 63-313182, 2-157878, 4-44075 to 4-44083, and 4-204980 to 4-204984.

In the image fixing device of the film heating method, a heat-resistant film (fixing film), constituting of a rotary heating member, is made to slide in contact with a heating member by a pressing rotary member (elastic roller), and a recording material bearing an unfixed image is introduced into the nip portion formed by the heating member and the pressing member across the heat-resistant film and is conveyed together with the heat-resistant film, whereby the unfixed image is fixed as a permanent image onto the recording material by the heat supplied from the heating member through the heat-resistant film and the pressure in the nip portion.

Such fixing device of the film heating method can achieve saving of the electric power consumption and reduction in the waiting time (improvement in the quick starting performance), because the heating member can be composed of a linear heating member of a low heat capacity and the heat-resistant film can be composed of a thin film of a low heat capacity.

In such fixing device, there is known a type in which a driving roller is provided inside the internal periphery of the film and the film is driven under tension, and another type (pressing rotary member driving type) in which the film is loosely fitted on a film guide and is driven by the pressing rotary member.

Recently the latter type (pressing rotary member driving type) is widely employed because of the reduced number of components in this type.

In the fixing device of the film heating method explained above, the heat capacity has to be reduced for realizing the on-demand performance, and there is required temperature control as explained in the following.

In the fixing device of the film heating method, since the amount of heat given to the paper varies considerably by the temperature of the pressing roller, it is necessary to vary the controlled temperature so as to give a constant amount of heat to the paper, depending on the number of prints or the time elapsed after the preceding fixing operation.

More specifically, the controlled temperature is set higher when the temperature of the pressure roller is low after the start of power supply, but is gradually lowered when the temperature of the pressure roller is elevated by the repeated printing operations.

Such temperature control allows to prevent the defective image fixation or the hot offset phenomenon.

FIG. 6 shows an example of the temperature control, wherein the abscissa indicates the number of prints while the ordinate indicates the controlled temperature.

The example shown in FIG. 6 is the case of continuous printing, in which the controlled temperature is lowered at every 10 sheets.

The controlled temperature is however not lowered endlessly. As the temperature of the pressure roller becomes stabilized after processing about 50 sheets, such stabilized temperature is selected as the final controlled temperature.

Also in case of the intermittent printing, in which printing operation and pause alternate, the interval between the printing operations or the internal between the sheets becomes larger, so that the pressure roller is heated for long time by the heater through the fixing film and the temperature of the pressure roller becomes higher than in the continuous printing operation.

Consequently the controlled temperature is lowered from the fewer number of sheets than in the continuous printing operation.

It is indicated by a broken line in FIG. 6.

However, in case of the intermittent printing, temperature control cannot always be made same, because the temperature of the pressure roller varies depending on the length of pause between the printing operations.

For example, in the conventional method, the last temperature control is executed after intermittent printing of 30 sheets, but, if a long pause period follows thereafter, the high controlled temperature is adopted again because the temperature of the pressure roller is lowered.

For this purpose, in order to estimate the temperature of the pressure roller, the temperature of the heater has been detected with a sensor such as the thermistor provided on the heater for temperature control and is entered into a corresponding table for realizing optimum temperature control.

However, in the above-described on-demand fixing device, there has only be considered the temperature of the pressure roller in a portion corresponding to the thermistor.

Consequently, after the printing of a small-sized sheet such as an envelope, the temperature of the pressure roller can be detected in the area passed by such sheet in the longitudinal direction of the pressure roller, but, since the heater generates heat uniformly over the entire sheet passing area in the longitudinal direction of the pressure roller, the temperature becomes higher in the area not passed by the sheet because the heat is not carried away by the sheet (so-called temperature elevation in the sheet non-passing area).

In such situation, if the heater temperature is controlled by the temperature detected by the thermistor present in the sheet-passing area, the image fixation becomes excessive in the sheet non-passing area, resulting in image smear by the hot offsetting.

Also in case a small-sized sheet is passed in the nip portion whereby the temperature of the pressure roller becomes higher in the sheet non-passing area and a next sheet is larger than the preceding sheet, the moisture contained in such sheet evaporates, at the entry into the fixing nip, by the heat of the high temperature portion of the pressure roller and is deposited on the pressure roller, particularly in the portion of the non-higher temperature.

It is revealed that the moisture deposited on the pressure roller reduces the transporting ability thereof, whereby the sheet causes slippage and becomes unable to enter the fixing nip.

It is also found that such phenomenon is apt to occur in case of using the pressing roller drive type or in case of using the pressure roller of good releasing property (such as a roller of which surface layer is composed of a fluorinated resin tube).

SUMMARY OF THE INVENTION

In consideration of the foregoing, an object of the present invention is to provide an image fixing device free from defective image fixation when the size of the recording material is changed from a smaller one to a larger one.

Another object of the present invention is to provide an image fixing device capable of suppressing the amount of moisture evaporating from the sheet, thereby preventing sheet slippage.

Still another object of the present invention is to provide an image fixing apparatus comprising a heater for generating heat upon electric power supply thereto; a film movable with an unfixed image on a recording material while being in contact with the heater; a backup roller for forming a nip with the heater, with the film being interposed in the nip; fixing condition setting means for setting an image fixing condition in accordance with the size of the recording material conveyed into the nip in the preceding image fixing operation and with the size of the recording material conveyed in the current image fixing operation.

Still other objects of the present invention, and the features thereof, will become fully apparent from the following detailed description, which is to be taken in conjunction with the attached drawings.

DETAILED DESCRIPTION OF THE PREFERRED EMBODIMENTS

Now the present invention will be clarified in detail by preferred embodiments thereof, with reference to the attached drawings. However, in these embodiments, the dimension, material, shape, relative position etc. of the components contained therein are not limited the present invention, unless specifying description is particularly given.

First Embodiment

Now there will be explained an image forming apparatus constituting a first embodiment of the present invention, with reference to FIGS. 1 to 6.

Figure 1:
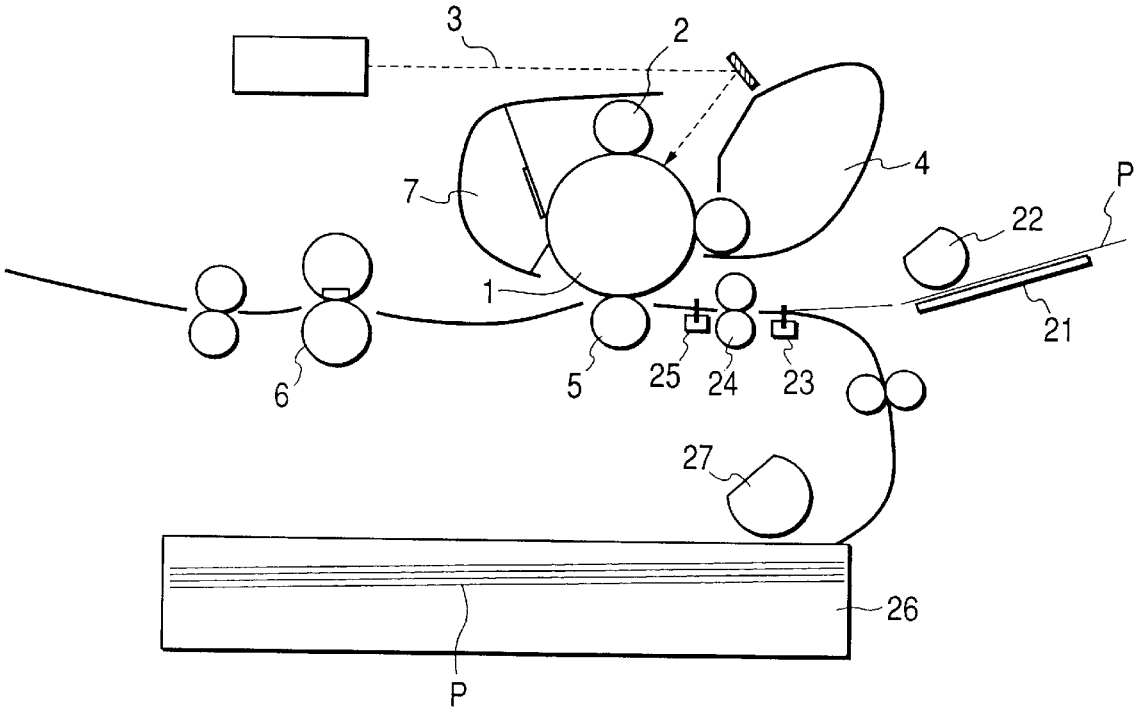
FIG. 1 is a schematic view showing the configuration of an image forming apparatus embodying the present invention.

At first explained is the configuration of the entire image forming apparatus with reference to FIG. 1, which is a schematic view showing the configuration of the image forming apparatus embodying the present invention.

In FIG. 1, a photosensitive drum 1 constituting an image bearing member is composed of a photosensitive material such as OPC, formed on a cylindrical substrate for example of aluminum or nickel.

In image formation, at first, the surface of the photosensitive drum 1 is uniformly charged with a charging roller 2 serving as the charging device.

Then a laser beam 3 constituting exposure means is on/off controlled according to the image information and executes scanning exposure, thereby forming an electrostatic latent image on the photosensitive drum 1.

The electrostatic latent image is developed with a developing device 4 and is rendered visible as an unfixed image (toner image).

The development is achieved for example by jumping development, and there is often employed a combination of imagewise exposure and reversal development.

A recording material P is taken from a manual insertion tray 21 or a cassette 26 by a sheet feeding roller 22 or 27, and is supplied to a transfer nip formed by the photosensitive drum 1 and a transfer roller 5, in synchronization, by registration rollers 24, with the toner image formed on the photosensitive drum 1.

In the transfer nip, the toner image is transferred from the photosensitive drum 1 to the recording material P by a transfer bias applied from an unrepresented power source.

The recording material P bearing the toner image is conveyed to a fixing device 6 constituting heating means, and is subjected to the application of heat and pressure in a nip portion of the fixing device 6 whereby the toner image is permanently fixed to the recording material P. Thereafter the recording material P is discharged from the apparatus.

On the other hand, the retentive toner remaining on the photosensitive drum 1 after the image transfer is eliminated from the surface thereof by a cleaning device 7.

In the following there will be explained the fixing device constituting heating means and featuring the embodiment of the present invention, with particular reference to FIG. 2, which is a schematic cross-sectional view of the fixing device of the present embodiment.

Figure 2:
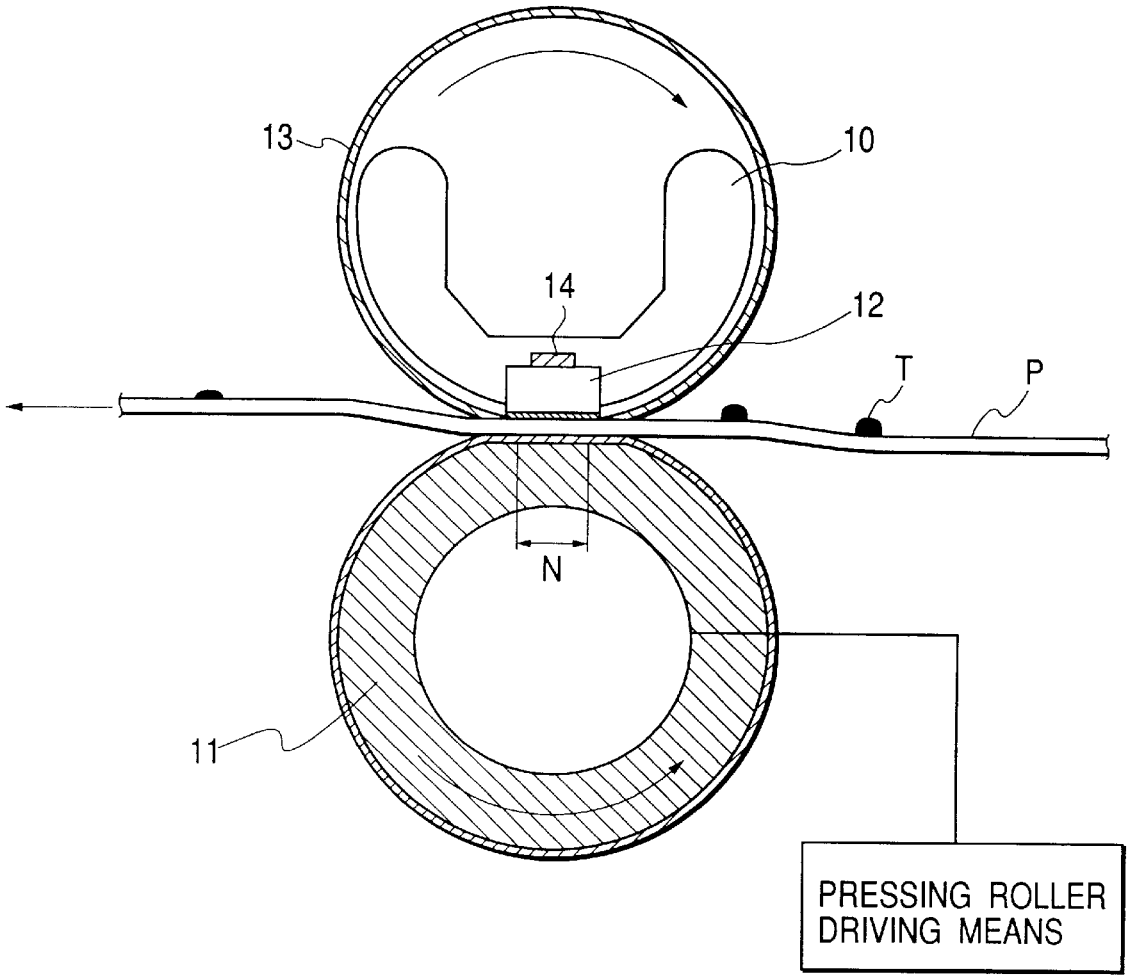
FIG. 2 is a schematic view showing the configuration of an image fixing device embodying the present invention.

Referring to FIG. 2, a heat-resistant film (fixing film) 13 formed as an endless belt and constituting a rotary heating member is loosely fitted around a semi-arc-shaped film guide member (stay) 10.

In order to improve the quick starting performance by reducing the heat capacity of the film 13, the total thickness thereof is advantageously selected as 100 $\mu$m or less, preferably within a range from 40 to 20 $\mu$m.

The film 13 can be composed of a single-layered film of a resinous material with satisfactory heat resistance, releasing property, mechanical strength and durability such as PTFE, PFA or PPS, or a composite film obtained by forming a releasing layer of PTFE, PFA, FEP etc. on a substrate film for example of polyimide, polyamidimide, PEEK, PES etc.

A ceramic heater 12 is composed of a heat generating member formed by printing heat-generating paste and a glass coating for protection of the heat-generating member and surface insulation, formed in succession on a ceramic substrate, and can generate heat by the supply of an AC current under power control to the heat-generating member of the heater 12.

On the rear side of the ceramic substrate, there is adhered a chip thermistor 14, which detects the temperature change when the heater is turned on or off for a predetermined period while the sheet is not passed. The target temperature of the heater is determined by the result of detection, and unrepresented heat driving means is accordingly controlled to effect the electric power control of the heater 12, thereby maintaining the heater at the target temperature (printing temperature).

In the fixing device of the present embodiment, the temperature detection has a configuration based on a lateral side, in which the temperature sensor is positioned in the vicinity of an end of the heater in the longitudinal direction thereof, in such a manner that an end portion of the recording material always passes the position of the temperature sensor regardless of the size of the recording material.

A pressure roller 11 constituting a rotary pressing member is a rotary member composed of an elastic layer of heat-resistant rubber such as silicone rubber or a porous elastic layer formed by foamed silicone rubber, formed on a metal core, and, on the elastic member, there may also be advantageously formed a heat-resistant releasing layer composed of fluorinated resin such as PFA, PTFE or FEP.

The pressure roller 11 is biased toward the heating member by unrepresented springs, and is rotated by unrepresented drive means, and the recording material P and the fixing film 10 are driven by the pressure roller 11.

The unfixed toner image is subjected to the application of heat and pressure in the nip portion formed by the heating portion (film and ceramic heater) of the fixing device and the pressure roller, and is fixed to the recording material P. The recording material P after image fixation is discharged from the apparatus.

In the following there will be explained, with reference to FIGS. 3, 4 and 5, the control sequence of the image forming apparatus of the above-described configuration.

Figure 3:
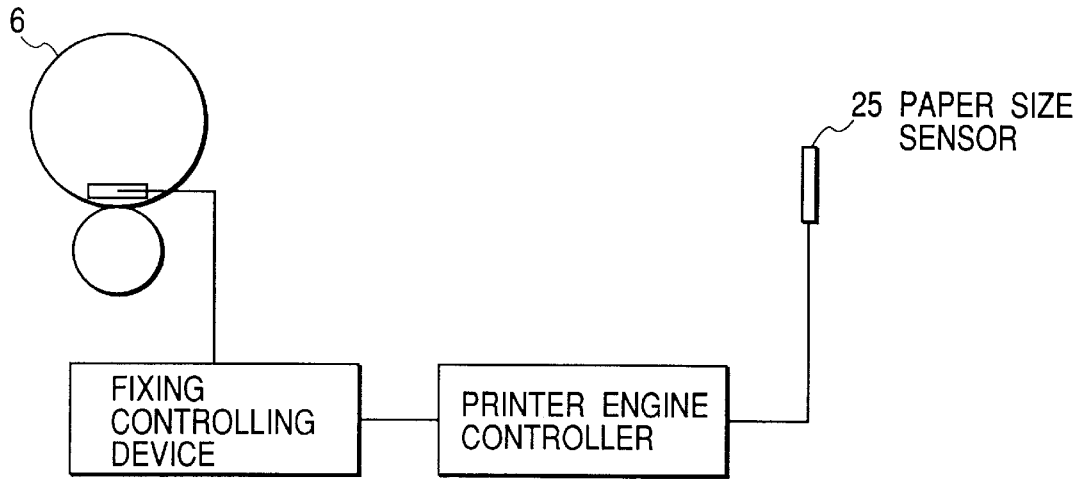
FIG. 3 is a block diagram of an image forming apparatus embodying the present invention.
Figure 4:
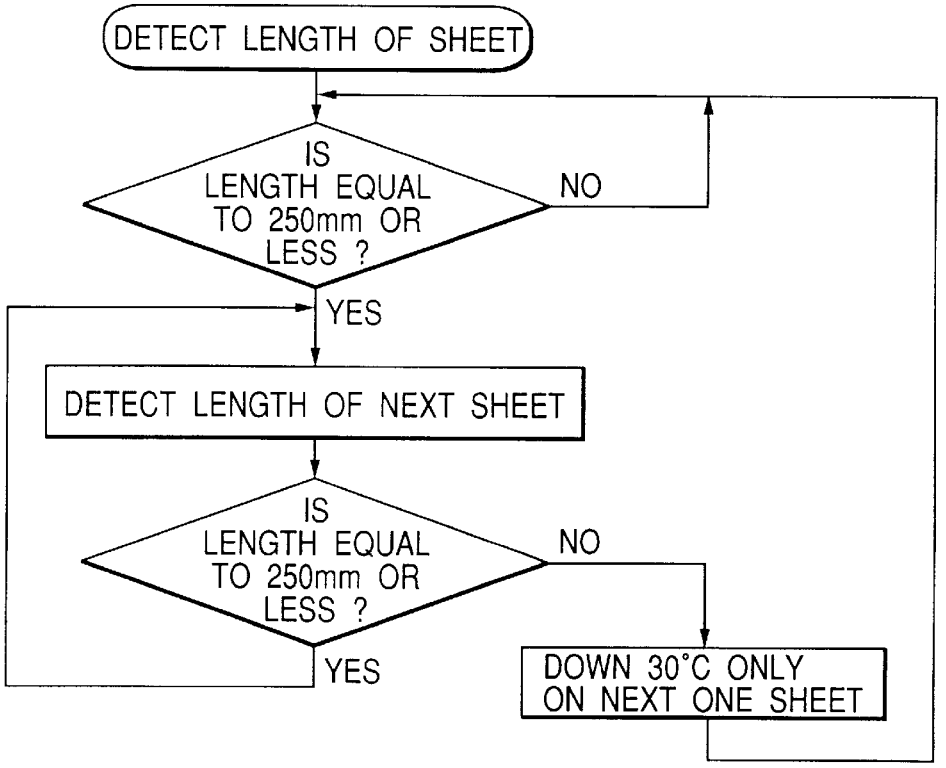
FIG. 4 is a flow chart showing the functions of an image fixing device constituting a first embodiment of the present invention.
Figure 5:
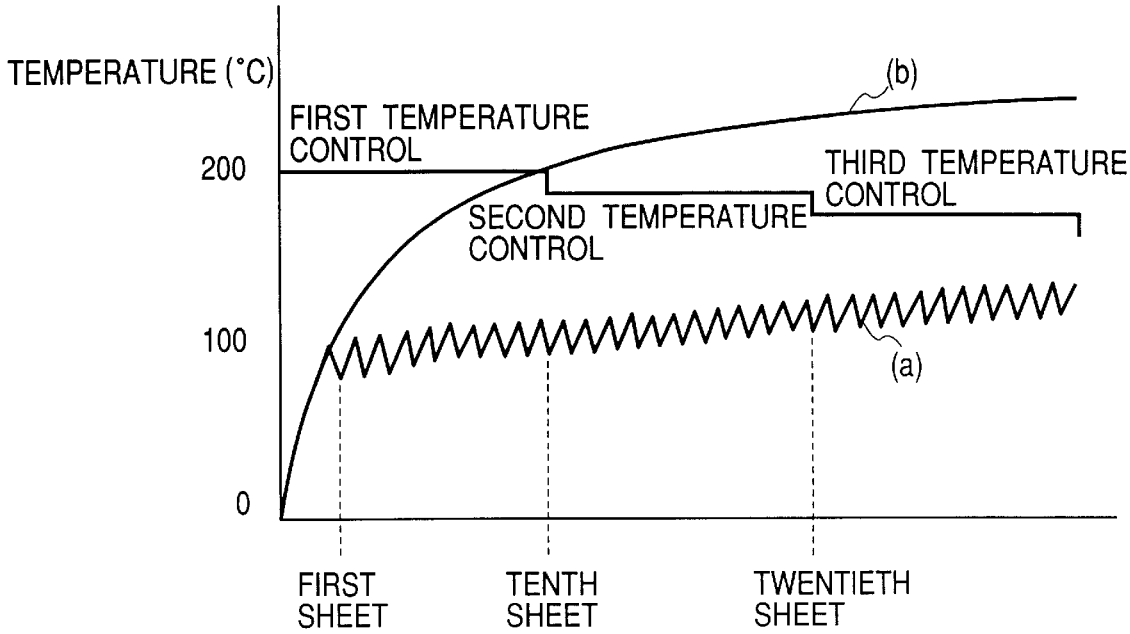
FIG. 5 is a chart showing the temperature change of a pressure roller, provided in the image fixing device of the first embodiment of the present invention.

FIG. 3 is a block diagram of the image forming apparatus of the present embodiment, while FIG. 4 is a flow chart showing the control sequence of the image fixing device of the first embodiment of the present invention, and FIG. 5 is a chart showing the temperature change of the pressure roller provided in the image fixing device of the first embodiment.

In the present embodiment, there will be explained control for preventing hot offsetting phenomenon or defective fixation in case of printing an ordinary paper of a normal size, after printing an envelope of a small size.

In the present embodiment, the set temperature of temperature control is lowered by a predetermined value in case of printing of normal size within a predetermined period (60 seconds in the present embodiment) after passing at least one small-sized sheet such as envelope.

The sheet size is determined by the sheet size information designated by the user or detected by a sensor 25 shown in FIG. 1. In the present embodiment, a sheet having a length 250 mm or less is identified as the small-sized sheet.

More specifically, as shown in a flow chart shown in FIG. 4, the length of the printing sheet is detected, and, if the length of the first sheet is 250 mm or less, such fact is memorized. Then, if the length of the next (second) sheet is 250 mm or less, the set temperature is maintained same as for the previous (first) sheet, but, if the length of the second sheet exceeds 250 mm, the set temperature for the second printing is lowered (by 30° C. in the present embodiment).

In this manner the set temperature is lowered in case of printing the recording material of the normal (or large) size after printing at least one small-sized recording material.

FIG. 5 is a chart showing the temperature change in the pressure roller in case of continuous printing of 30 envelopes of COM10 size (standard-size envelope 241 by 105 mm) after the power supply of the image fixing device is turned on.

During the printing operation, the pressure roller in the sheet-passing area repeats cycles of being heated in the interval between the sheets and being cooled during the passage of each sheet, whereby the temperature gradually rises from about 80° C. to about 100° C. with vibrating fluctuation (as indicated by (a) in FIG. 5).

On the other hand, in the sheet non-passing area, the temperature of the pressure roller monotomously rises during the printing operation, reaching about 100° C. at the first sheet, about 200° C. at the tenth sheet and about 220° C. at the thirtieth sheet, thus always considerably higher than that in the sheet passing area, and becomes almost saturated at about 230° C. at the fourtieth to fiftieth sheets (as indicated by (b) in FIG. 5).

Though not illustrated in FIG. 5, the temperature of the pressure roller starts to descend after the envelope printing operation, but is still as high as about 200° C. in the sheet non-passing area at several ten seconds after the end of the envelope printing operation.

On the other hand, the temperature in the sheet passing area is in a range of about 100° C. to 70° C., so that a large temperature difference is generated between the sheet passing area and the sheet non-passing area.

Figure 6:
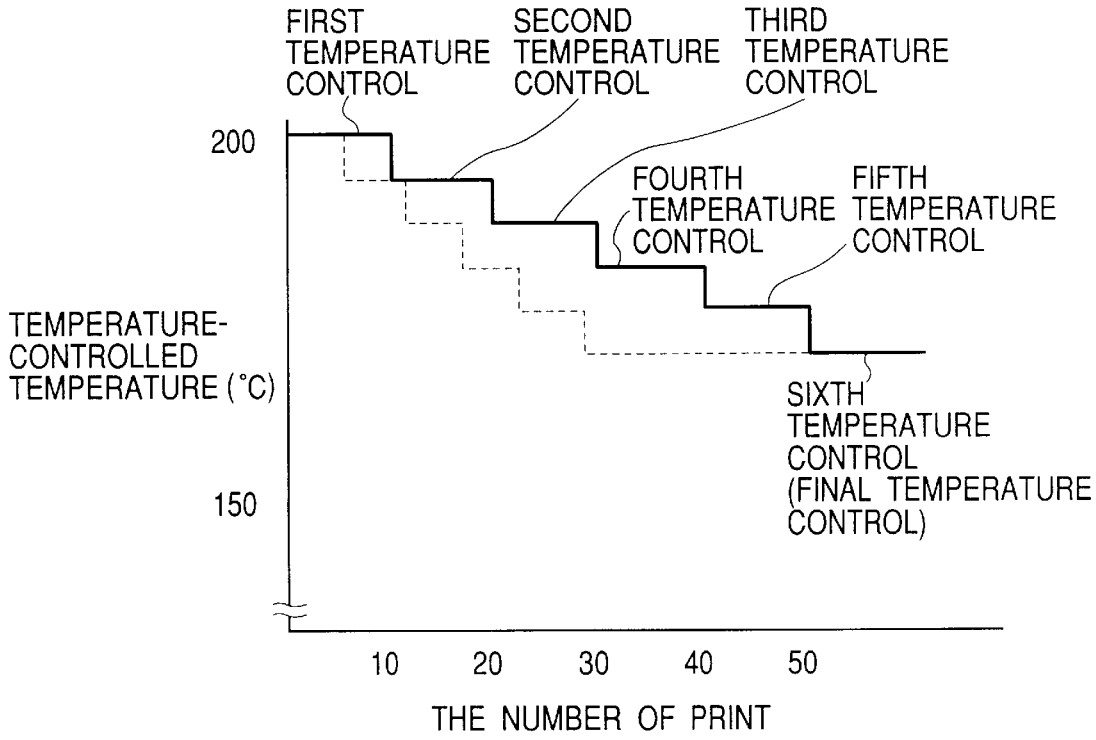
FIG. 6 is a chart showing an example of temperature control.

In this state (after continuous printing of 30 envelopes of COM10 size), in case the sheets of ordinary size (A4 size in this case) are to be printed in continuation, the conventional control executes the printing operation at the third temperature control of 190° C. shown in FIG. 6.

The nip temperature becomes adequate for the image fixation when the temperature of the pressure roller is about 100° C. Therefore, at such set temperature, satisfactory image fixation can be attained in the area where the envelopes have passed, but excessive fixation may take place in the area where the envelopes have not passed, thus eventually inducing hot offsetting phenomenon.

Consequently, in the control of the present embodiment, there is assumed a mode of reducing the controlled temperature by 30° C. and temperature control at 160° C. is effected, after the envelope printing.

The following table shows the comparison of the fixing performance and the hot offsetting phenomenon in the present embodiment (with the temperature control at 160° C.) and in a reference example (with the temperature control at 190° C.).

TABLE 1

| | Present embodiment | | Reference example | |
|---|---|---|---|---|
| | Sheet passing area | Sheet non-passing area | Sheet passing area | Sheet non-passing area |
| Fixing performance | Satisfactory good | Satisfactory good | Satisfactory good | Satisfactory not good |
| Hot offsetting | | | | |

According to the results shown in Table. 1, the present embodiment provided satisfactory fixing performance and did not show the hot offsetting phenomenon. On the other hand, the reference example showed satisfactory fixing performance but generated the hot offsetting phenomenon in the sheet non-passing area.

In the foregoing, there has been explained the case of printing the ordinary sheets after printing 30 envelopes. In the following there will be explained a case of printing the ordinary sheets after printing an envelope.

After printing an envelope, as shown in FIG. 5, the sheet non-passing area of the pressure roller is heated to about 120° C. while the sheet passing area is heated to about 80° C. to 90° C., with a temperature difference of about 20° C., so that the hot offsetting is lighter than after the printing of 30 envelopes, even in the reference example.

With the set temperature of 200° C. in the first temperature control, the present embodiment can completely eliminate the hot offsetting by lowering the set temperature by 30° C. to 170° C. in fixing the ordinary sheet after the printing of the envelope.

Such control reduces the image fixing performance by a certain extent, but the image fixation is practically acceptable, without peeling of characters in the environment of ordinary temperature of 23° C., even on the bond paper on which the image fixation is more difficult.

Also in the present embodiment, in case of printing of the ordinary size sheets after passing envelopes, the set temperature is lowered by a predetermined amount, so that the image fixing performance for the ordinary-sized sheets after passing the envelopes can be stabilized without complication in the temperature control sequence.

Primarily, to avoid the hot offsetting and the defective image fixation, the set temperature is determined to avoid the hot offsetting and poor fixation. However, in case of using the small-sized sheet such as envelope, the hot offsetting can not be avoided because the temperature distribution in the longitudinal direction of the pressure roller becomes uneven. This drawback can be laminated by the above-described control.

Such control is particularly effective in an image forming apparatus with a high process speed, in which the temperature difference between the sheet passing area and the sheet non-passing area becomes larger inthe printing of small-sized sheets.

As explained in the foregoing, in case of the printing operation after the printing of the small-sized sheet such as envelope, thereby can be obtained an effect of preventing the hot offsetting and sheet jamming by slippage by estimating the temperature of the pressure roller in the area to be passed by the next recording material and determining adequate temperature control based on such estimated temperature.

It is therefore rendered possible to constantly achieve satisfactory image fixation, thereby maintaining satisfactory quality in the formed image.

Second Embodiment

Figure 7:
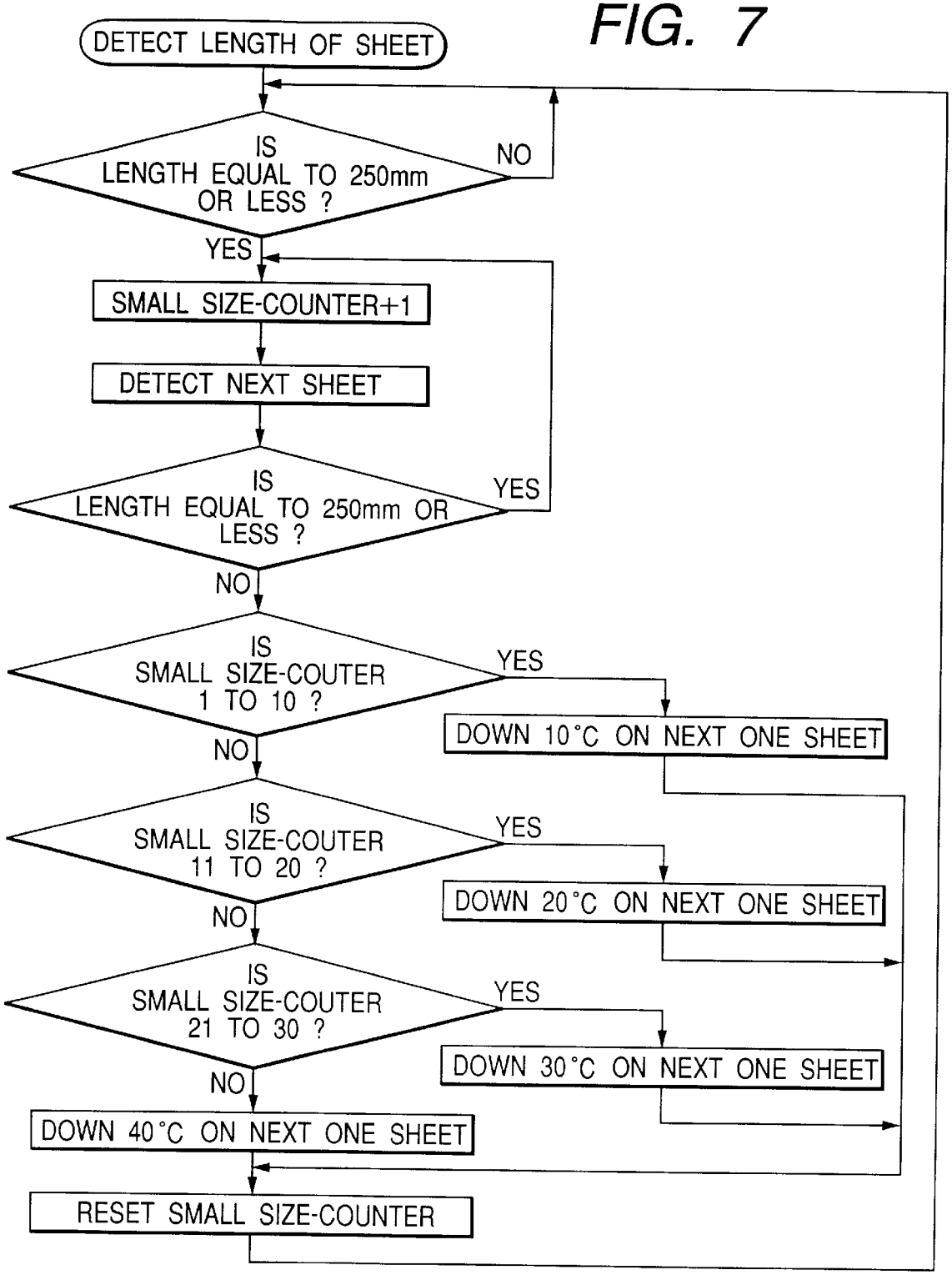
FIG. 7 is a flow chart showing the functions of an image fixing device constituting a second embodiment of the present invention.

FIG. 7 shows the control sequence of a second embodiment of the present invention. In contrast to the foregoing first embodiment, the set temperature is lowered always by a predetermined value in case of switching from the small-sized recording material to the ordinary-sized recording material, the second embodiment varies the amount of descent of the controlled temperature according to the number of fixation of the small-sized recording materials (namely number of prints), in case of change to the ordinary-sized recording material.

Other parts and functions of the second embodiment are same as those in the first embodiment, so that components equivalent to those in the first embodiment are represented by corresponding numbers and will not be explained further.

FIG. 7 is a flow chart showing the control sequence of the image fixing device of the second embodiment.

In the present embodiment, in case of printing the ordinary-sized sheets after printing envelopes, the lowered set temperature for the printing of the ordinary-sized sheets is varied according to the number of the passed envelopes.

More specifically, as exemplified in FIG. 7, the length of the printed sheet is detected and, if it is 250 mm or less, such situation is memorized. If the length of the next second sheet is also 250 mm or less, the controlled temperature is maintained same as that for the preceding (first) printing operation, but, if the length exceeds 250 mm, the set temperature is lowered. This control is similar to that in the foregoing first embodiment, but, in the present embodiment, there is counted the number of passed sheets not exceeding 250 mm, and the amount of temperature descent is varied according to the count.

In the present embodiment, the temperature is lowered by 10° C. in case of fixing the ordinary-sized sheet after continuous printing of 1 to 10 small-sized sheets, by 20° C. in case of fixing the ordinary-sized sheet after continuous printing of 11 to 20 small-sized sheets, by 30° C. in case of fixing the ordinary-sized sheet after continuous printing of 21 to 30 small-sized sheets, or by 40° C. in case of fixing the ordinary-sized sheet after continuous printing of 31 or more small-sized sheets.

The continuous printing mentioned above includes continuous printing and intermittent printing within an interval not exceeding 60 seconds.

The following table shows the comparison of the fixing performance and the hot offsetting phenomenon in the present embodiment (set temperature being varied according to the number of printing of the small-sized recording materials) and in a reference example (with the temperature control at 190° C.).

TABLE 2

| | | Present embodiment | | Reference example | |
|---|---|---|---|---|---|
| Number of envelopes passed | | Sheet passing area | Sheet non-passing area | Sheet passing area | Sheet non-passing area |
| 1 | Fixing performance | satisfactory | satisfactory | satisfactory | satisfactory |
| | Hot offsetting | good | good | good | not good |
| 20 | Fixing performance | satisfactory | satisfactory | satisfactory | satisfactory |
| | Hot offsetting | good | good | good | not good |
| 30 | Fixing performance | satisfactory | satisfactory | satisfactory | satisfactory |
| | Hot offsetting | good | good | good | not good |
| 40 | Fixing performance | satisfactory | satisfactory | satisfactory | satisfactory |
| | Hot offsetting | good | good | good | not good |

According to the results shown in Table. 2, the present embodiment provided satisfactory fixing performance even after a single envelope, since the amount of descent of the fixing temperature is varied according to the number of printing of the small-sized sheet such as envelope.

Also the hot offsetting could be prevented even after printing about 40 envelopes.

As explained in the foregoing, the present embodiment can achieve satisfactory image fixation regardless of the number of printing of the small-sized sheet such as envelope, though the temperature control sequence is more complex than in the first embodiment.

Third Embodiment

Figure 8:
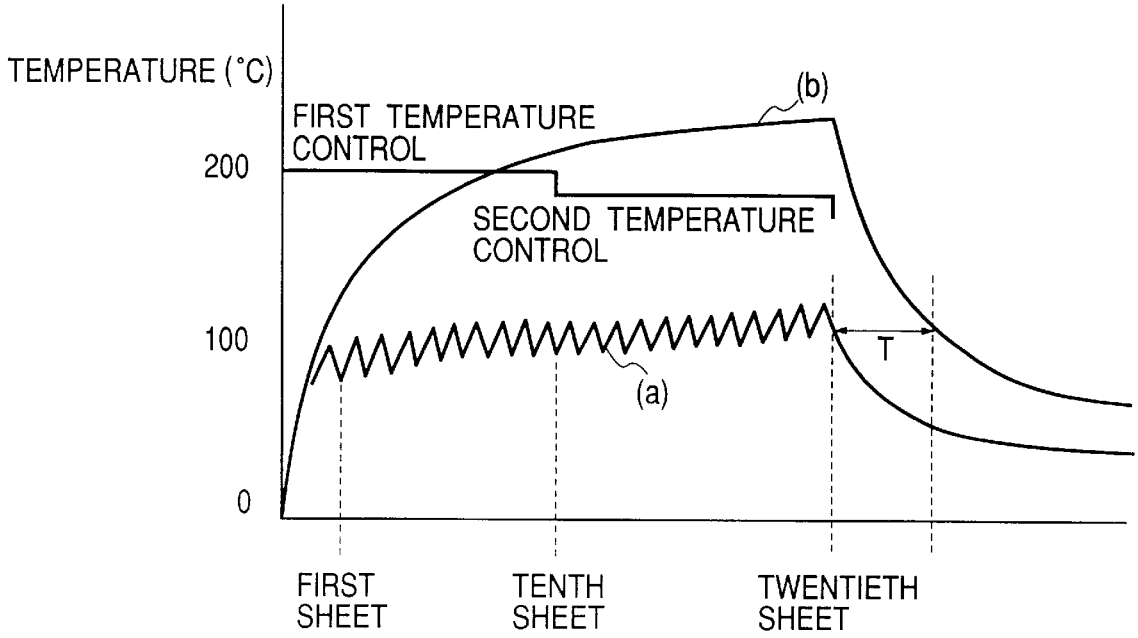
FIG. 8 is a chart showing the temperature change of a pressure roller, provided in the image fixing device of a third embodiment of the present invention.

FIG. 8 illustrates a third embodiment of the present invention. In the foregoing embodiments, the set temperature is lowered in case of changing from the small-sized recording material to the ordinary-sized recording material, but, in the present embodiment, the period of pause in the printing operation is changed (elongated) in case of such change from the small-sized recording material to the ordinary-sized recording material.

Other parts and functions of the third embodiment are same as those in the first embodiment, so that components equivalent to those in the first embodiment are represented by corresponding numbers and will not be explained further.

FIG. 8 is a chart showing the temperature change of the pressure roller provided in the image fixing device of the third embodiment.

In the present embodiment, in case of printing the ordinary-sized sheet after printing the small-sized sheet such as envelope, the period of pause in the printing operation for the ordinary-sized sheet is varied according to the number of the passed small-sized sheets.

The pressure roller employed in the image fixing device provided in the image forming apparatus of the present embodiment is a rotary member having an elastic layer of heat-resistant rubber such as silicone rubber or a porous elastic layer of foamed silicone rubber, on a metal core, and a tube of fluorinated resin such as PFA is provided on the external periphery.

In the present embodiment, the period of pause in the printing of the ordinary-sized sheets is selected as 10 seconds after a continuous printing operation of 1 to 10 small-sized sheets such as envelopes, 30 seconds after a continuous printing operation of 11 to 20 small-sized sheets, 60 seconds after a continuous printing operation of 21 to 30 small-sized sheets, or 90 seconds after a continuous printing operation of 30 or more small-sized sheets.

The continuous printing mentioned above includes continuous printing and intermittent printing within an interval not exceeding 60 seconds.

The period of pause mentioned above means the period during which the start of the printing operation is delayed in case a print signal for the ordinary-sized printing is received. Stated differently, in case of effecting the printing of the ordinary-sized sheet within 60 seconds after the end of the printing of the envelope, the start of the printing of the ordinary-sized sheet is intentionally delayed.

If the received print signal is for the printing of the small-sized sheet same as in the preceding printing operation, the printing operation is continued without pause.

FIG. 8 shows the descent of temperature of the pressure roller after printing of 20 envelopes of COM10 size.

In FIG. 8, (a) indicates the temperature change in the sheet passing area, while (b) indicates that in the sheet non-passing area.

In FIG. 8, T indicates a period required by the sheet non-passing portion of the pressure roller to cool down to a temperature substantially same as the temperature of the sheet passing area in the printing operation.

According to the measurement in the present embodiment, T was about 30 seconds.

Thus, even if the print signal for the ordinary sheet is received immediately after the print of 20 envelopes, the printing operation of the ordinary sheet is started after a pause of 30 seconds from the end of the envelope printing.

The pressure roller, which was at about 230° C. at the end of the envelope printing, was cooled in the pause of 30 seconds to about 120° C. which was same as the temperature of the sheet passing area in the printing operation, the hot offsetting phenomenon was not observed in the sheet non-passing area.

In this situation, the pressure roller is naturally cooled also in the sheet passing area, but the cooling is faster in the sheet non-passing area of the higher temperature, and the defective fixation was not particularly found in the sheet passing area.

Similarly the hot offsetting and the defective image fixation were not observed in the printing of the ordinary sheets after printing 1, 10, 30 or 50 envelopes.

As explained in the foregoing, the present embodiment provides the advantages of preventing hot offset phenomenon and sheet jamming by slippage, in the next printing operation after the printing of a small-sized sheet such as an envelope, by estimating the temperature of the pressure roller in the passing area of the recording material for the next printing operation and setting an adequate period of pause, according to thus estimated temperature, prior to the next printing operation.

Fourth Embodiment

In the foregoing third embodiment, in case of change from a small-sized recording material to an ordinary-sized recording material, the period of pause is varied according to the number of the passed small-sized recording materials, but, in the present embodiment, in such situation, the pre-rotation time and the post-rotation time of the printing operation are varied according to the number of the passed small-sized recording materials.

Other parts and functions of the fourth embodiment are same as those in the first embodiment, so that components equivalent to those in the first embodiment are represented by corresponding numbers and will not be explained further.

Figure 9:
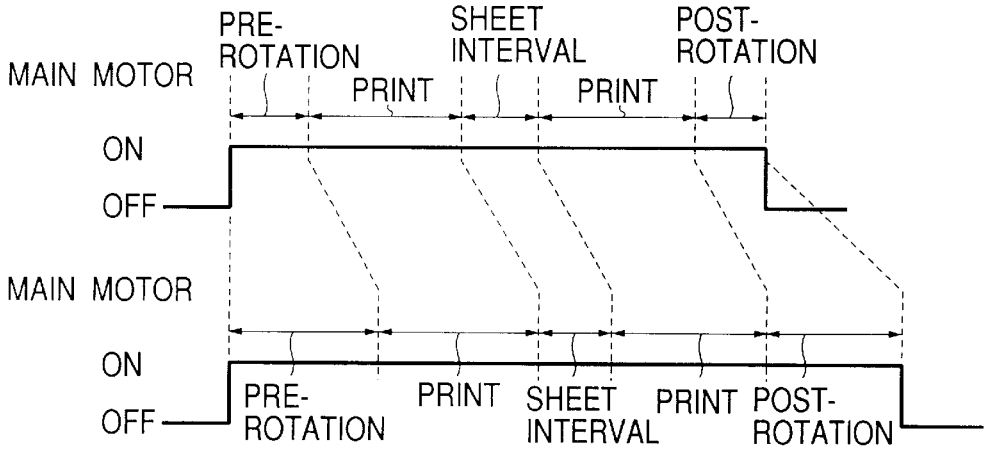
FIG. 9 is a timing chart showing the functions of an image forming apparatus constituting a fourth embodiment of the present invention.

In the present embodiment, in case of printing the ordinary-sized sheet after printing of the small-sized sheet, the pre-rotation time and the post-rotation time of the printing operation for the ordinary-sized sheet are varied as shown in FIG. 9, according to the number of the passed small-sized sheets.

FIG. 9 is a timing chart of the functions of the image forming apparatus of the fourth embodiment, wherein the upper part shows an ordinary function and the lower part conceptually shows the function after the above-described control.

The pre-rotation generally means a preparatory operation for the printing, after the reception of the print signal, including the sheet feeding, charging of the photosensitive drum, latent image formation thereon, temperature control of the fixing device etc.

Also the post-rotation means the finishing operations after the printing operation, including the discharge of the printed sheet to the discharge tray, cleaning of the transfer roller, cleaning of the retentive toner on the photosensitive drum etc.

As an example, in case of printing two sheets, there are continuously executed steps of pre-rotation, printing, interval, printing and post-rotation as shown in FIG. 9, and the main motor continues to be driven during these steps.

The present embodiment executes such control as to extend the pre-rotation period or the post-rotation period thereby lowering the temperature of the pressure roller in the sheet non-passing area.

The pressure roller employed in the image fixing device provided in the image forming apparatus of the present embodiment is a rotary member having an elastic layer of heat-resistant rubber such as silicone rubber or a porous elastic layer of foamed silicone rubber, on a metal core, and a tube of fluorinated resin such as PFA is provided on the external periphery.

The control of the present embodiment is executed in the following manner.

After printing 1 to 10 small-sized sheets, the post-rotation period is extended by 5 seconds, and, if the next printing operation is to be executed on the ordinary-sized sheet, the pre-rotation period is extended by 5 seconds.

After printing 11 to 20 small-sized sheets, the post-rotation period is extended by 15 seconds, and, if the next printing operation is to be executed on the ordinary-sized sheet, the pre-rotation period is extended by 15 seconds.

After printing 21 to 30 small-sized sheets, the post-rotation period is extended by 30 seconds, and, if the next printing operation is to be executed on the ordinary-sized sheet, the pre-rotation period is extended by 30 seconds.

After printing 31 or more small-sized sheets, the post-rotation period is extended by 45 seconds, and, if the next printing operation is to be executed on the ordinary-sized sheet, the pre-rotation period is extended by 45 seconds.

The continuous printing mentioned above includes continuous printing and intermittent printing within an interval not exceeding 60 seconds.

The post-rotation period is extended in case the next print signal is not yet received at the end of the printing operation of the small-sized sheet, or in case a next print signal for the ordinary-sized sheet is received.

The pre-rotation period is extended in case the next print signal is for the ordinary-sized sheet, but is not extended in case the next print signal is for the small-sized sheet same as in the preceding printing operation.

In the foregoing description, the extension is made on both the pre-rotation period and the post-rotation period, but it is also possible to extend the pre-rotation period only.

Also in the present embodiment, the descent of temperature of the pressure roller after printing 20 envelopes of COM10 size is similar to that in the foregoing fourth embodiment illustrated in FIG. 8.

In FIG. 8, T indicates a period required by the sheet non-passing portion of the pressure roller to cool down to a temperature substantially same as the temperature of the sheet passing area in the printing operation.

According to the measurement in the present embodiment, T was about 30 seconds.

The pressure roller, which was at about 220° C. at the end of the envelope printing, was cooled in the pause of 30 seconds to about 120° C. which was same as the temperature of the sheet passing area in the printing operation, the hot offsetting phenomenon was not observed in the sheet non-passing area. In this situation, the pressure roller is naturally cooled also in the sheet passing area, but the cooling is faster in the sheet non-passing area of the higher temperature, and the defective fixation was not particularly found in the sheet passing area.

Similarly the hot offsetting and the defective image fixation were not observed in the printing of the ordinary sheets after printing 1, 10, 30 or 50 envelopes.

As explained in the foregoing, the present embodiment provides the advantages of preventing hot offset phenomenon and sheet jamming by slippage, in the next printing operation after the printing of a small-sized sheet such as an envelope, by estimating the temperature of the pressure roller in the passing area of the recording material for the next printing operation and adequately extending the pre-rotation period and the post-rotation period according thus estimated temperature, prior to the next printing operation.

As explained in the foregoing, the present invention enables adequate control of the temperature according to the information of the recording material to be fixed next and that of the recording material which has been fixed, thereby allowing to appropriately fixing the unfixed image and attaining stable image quality even in case of continuous printing operation with a change in the size of the recording material.

The present invention also allows to obtain a desired temperature distribution in the heating portion by controlling the period of pause in the printing operation according to the information of the recording material to be fixed next and that of the recording material which has been fixed, thereby allowing to appropriately fixing the unfixed image and improving the image quality.

Furthermore, the present invention allows to obtain a desired temperature distribution in the heating portion by controlling the pre-rotation period and the post-rotation period according to the information of the recording material to be fixed next and that of the recording material which has been fixed, thereby allowing to appropriately fixing the unfixed image and improving the image quality.

The unfixed image can be appropriate fixed by effecting control according to the information on the number of already fixed recording materials, both for a few number or a large number of such recording materials.

Also by reducing the controlled temperature in case the size of the recording material to be fixed next is larger than that of the immediately preceding fixed recording material, the higher temperature induced by the small-sized recording material in an area can be reduced to obtain uniform temperature distribution.

The present invention is not limited to the foregoing embodiments but includes the modifications within the scope and spirit of the appended claims.

What is claimed is:

1. An image fixing apparatus, comprising:

a heater for generating heat upon receiving electric power supply thereto, said heater is controlled so as to maintain a set temperature;

a film movable with an unfixed image on a recording material while being in contact with said heater;

a backup roller for forming a nip with said heater, with said film being interposed in the nip; and fixing condition setting means for setting the set temperature according to a size of the recording material conveyed to the nip in a preceding image fixing operation and a size of the recording material conveyed to the nip in the current image fixing operation, wherein said fixing condition setting means reduces the set temperature when the recording material in the current image fixing operation is larger than that in the preceding image fixing operation.

2. An image fixing apparatus according to claim 1, further comprising drive means for driving said backup roller, wherein said film follows said backup roller to move.

3. An image fixing apparatus according to claim 1, wherein an amount of reduction of the set temperature is made larger as the number of the preceding image fixing operation increases.

4. An image fixing apparatus, comprising:

a heater for generating heat upon receiving electric power supply thereto;

a film movable with an unfixed image on a recording material while being in contact with said heater;

a backup roller for forming a nip with said heater, with said film being interposed between said heater and said backup roller in the nip; and fixing condition setting means for setting a start timing on a current image fixing operation according to a size of the recording material conveyed to the nip in a preceding image fixing operation and a size of the recording material conveyed to the nip in the current image fixing operation, wherein said fixing condition setting means delays the start timing of the current image fixing operation when the recording material in the current image fixing operation is larger than that in the preceding image fixing operation.

5. An image fixing apparatus, comprising:

a heating member for heating an image on a recording material, said heating member maintained at a set temperature;

a backup roller for forming a nip with said heating member; and fixing condition setting means for setting the set temperature, said fixing condition setting means reducing the set temperature in a current image fixing operation when a size of the recording material conveyed to the nip in a preceding image fixing operation is smaller than a predetermined size and a size of the recording material conveyed to the nip in the current image fixing operation is larger than the predetermined size.

6. An image fixing apparatus according to claim 5, wherein when a size of the recording material conveyed to the nip in a preceding image fixing operation is smaller than a predetermined size and a size of the recording material conveyed to the nip in the current image fixing operation is larger than the predetermined size, said fixing condition setting means reduces the set temperature to be set in accordance with the size of the recording material by a predetermined temperature.

7. An image fixing apparatus according to claim 6, wherein a reducing amount of the set temperature is set in accordance with number of continuous image fixing operation just before the current image fixing operation.

8. An image fixing apparatus according to claim 6, wherein the set temperature is further set in accordance with number of continuous image fixing operations.

9. An image forming apparatus, comprising:

an image forming means for forming an image on a recording material;

a heating member for heating the image on the recording material;

a backup roller for forming a nip with said heating member; and start timing setting means for setting a start timing on the image forming operation, said start timing setting means delays a start timing on a current image forming operation when a size of the recording material conveyed to the nip in a preceding image forming operation is smaller tham a predetermined size and a size of the recording material conveyed to the nip in the current image forming operation is larger than the predetermined size.

10. An image forming apparatus according to claim 9, wherein the delay time is set in accordance with number of continuous image forming operation just before the current image forming operation.

11. An image forming apparatus according to claim 9, wherein when a size of the recording material conveyed to the nip in a current image forming operation is smaller than the predetermined size, said backup roller extending a rotating time after finish of the current image forming operation.

12. An image forming apparatus according to claim 11, wherein said backup roller further extends the extended time when recording materials which are smaller than the predetermined size are continuously output by a number greater than a predetermined number.

13. A temperature setting method of an image fixing apparatus for heating an image on a recording material by passing the recording material into a nip of a pair of rotary members, said temperature setting method comprising steps of:

judging whether a size of the recording material used in a preceding image fixing operation is larger or smaller than a predetermined size;

judging whether a size of the recording material used in a current image fixing operation is larger or smaller than the predetermined size; and reducing a set temperature of said image fixing apparatus in the current image fixing operation when the size of the recording material of the preceding image fixing operation is smaller than the predetermined size and the size of the recording material of the current image fixing operation is larger than the predetermined size.

14. A temperature setting method according to claim 13, wherein, in the step of reducing the set temperature, the set temperature set in accordance with the size of the recording material is reduced by a predetermined temperature.

15. A temperature setting method according to claim 14, wherein a reducing amount of the set temperature is set in accordance with number of continuous image fixing operation just before the current image fixing operation.

16. An image forming starting control method of an image forming apparatus for fixing a recording material by a nip of a pair of rotary members to output after an image is formed on the recording material, said image forming starting control comprising steps of:

judging whether a size of the recording material used in a preceding image forming operation is larger or smaller than a predetermined size;

judging whether a size of the recording material used in a current image forming operation is larger or snaller than the predetermined size; and delaying a start of the current image forming operation when the size of the recording material of the preceding image forming operation is smaller than the predetermined size and the size of the recording material of the current image forming operation is larger than the predetermined size.

17. An image forming starting control method according to claim 16, wherein the delay time is set in accordance with number of continuous image forming operation just before the current image forming operation.

* * * * *

UNITED STATES PATENT AND TRADEMARK OFFICE

CERTIFICATE OF CORRECTION

PATENT NO. : 6,115,563
DATED : September 5, 2000
INVENTOR(S) : Toshio Miyamoto

It is certified that error appears in the above-identified patent and that said Letters Patent is hereby corrected as shown below:

Title page,
Item [56], RC:
Foreign Patent Documents: "4-04482" should read -- 4-044082 --.

Column 2,
Line 13, "internal" should read -- interval --; and
Line 38, "be" should read -- been --.

Column 7,
Line 37, "inthe" should read -- in the --.

Column 9,
Line 10, "are" should read -- are the --;
Line 47, "is" should be deleted; and
Line 48, "sheet" should read -- sheet is the --.

Column 10,
Line 19, "to" (1st occurrence) should read -- to the --.

Column 11,
Line 67, "of the" should read -- of the heating --.

Column 12,
Line 21, "appropriate" should read -- appropriately --.

Column 13,
Line 37, "with" should read -- with a --;
Line 38, "tion" should read -- tions --;
Line 40, "with" should read -- with a --;
Line 60, "with" should read -- with a --; and
Line 61, "operation" should read -- operations --.

UNITED STATES PATENT AND TRADEMARK OFFICE

CERTIFICATE OF CORRECTION

PATENT NO. : 6,115,563
DATED : September 5, 2000
INVENTOR(S) : Toshio Miyamoto

It is certified that error appears in the above-identified patent and that said Letters Patent is hereby corrected as shown below:

Column 14,
Line 5, "after" should read -- after the --;
Line 37, "with" should read -- with a --;
Line 38, "tion" should read -- tions --;
Line 48, "snaller" should read -- smaller --;
Line 58, "with" should read -- with a --; and
Line 59, "operation" should read -- operations --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*